United States Patent [19]

Hickerson

[11] 4,027,601

[45] June 7, 1977

[54] CONTAINER FOR EXPLOSIVE DEVICE

[75] Inventor: Frederick R. Hickerson, Newton, N.J.

[73] Assignee: The United States of America as represented by the Secretary of the Army, Washington, D.C.

[22] Filed: Apr. 19, 1976

[21] Appl. No.: 678,009

[52] U.S. Cl. ..... 109/1 R; 89/36 R; 109/49.5

[51] Int. Cl.[2] ..... F42D 5/04

[58] Field of Search ..... 89/1 R, 36 R, 36 A, 89/36 C, 36 F, 36 G; 109/1 R, 49.5, 58; 206/3

[56] References Cited

UNITED STATES PATENTS

| | | | |
|---|---|---|---|
| 2,315,799 | 4/1943 | La Guardia et al. | 109/49.5 |
| 3,731,585 | 5/1973 | Demberg et al. | 86/1 R |
| 3,800,715 | 4/1974 | Boller | 109/49.5 |
| 3,820,479 | 6/1974 | Fylling | 109/1 R |

*Primary Examiner*—Paul R. Gilliam

*Assistant Examiner*—David H. Corbin

*Attorney, Agent, or Firm*—Nathan Edelberg; A. Victor Erkkila; Thomas R. Webb

[57] ABSTRACT

A bomb container is made up of: a first open-ended hollow cylinder of steel having lifting ears, and adapted to rest on one end or the side; and a second open-ended hollow cylinder of steel positioned completely within the first cylinder, with their longitudinal axes substantially perpendicular to each other, and the ends of the second or inner cylinder contoured to closely fit the inner wall of the first or outer cylinder. The outer cylinder is mounted on a pair of elongated channel brackets, having struck-out ears or straps attached to the outside of the inner cylinder, and mounted on a flat support, such as a truck or trailer bed. The inner cylinder contains a liner of foam plastic, vermiculite or other suitable material to support a bomb near the middle of the cylinder and to break up and reduce the initial shock pressure level of an explosion therein.

6 Claims, 3 Drawing Figures

CONTAINER FOR EXPLOSIVE DEVICE

GOVERNMENT INTEREST

The invention described herein may be manufactured, used and licensed by or for the Government for governmental purposes without the payment to me of any royalty thereon.

BACKGROUND AND SUMMARY OF THE INVENTION

Various bomb containers have been developed and used for carrying an improvised explosive device (IED) or homemade bomb to a safe disposal area. Bomb container designs are basically of three types: (1) a cylindrical container open at both ends which vents the explosive gases from a detonation through the ends and provides protection from fragmentation only on the side; (2) a cylinder similar to (1) that is open only on one end (top) and provides added protection from fragments at the other end (bottom); and (3) a spherical container which totally contains the fragments and the blast. The spherical container offers the best protection, but requires an opening with a very complex and expensive door.

An object of the present invention is to provide a new and improved bomb container that achieves substantially as good protection as a spherical container but avoids the usual door thereof, at the expense of some additional weight.

In accordance with the invention, the bomb container is made up of a first open-ended hollow member of high strength material, such as a section of steel pipe, adapted to rest on one end or the side, and a second open-ended hollow member of similar material positioned completely within the first member, with their longitudinal axes substantially perpendicular to each other, and the ends of the second member contoured to the inner wall of the first member with only a small clearance therebetween. Preferably, the second member is mounted on a pair of elongated, tangential, mounting brackets attached to the opposite sides and mounted on a flat support, such as a truck or trailer bed. Also, the second member may be provided with a liner of a material, such as foam plastic, capable of supporting a bomb near the center of the member and of breaking up and reducing the initial shock pressure level of an explosion therein.

DETAILED DESCRIPTION OF A PREFERRED EMBODIMENT

Figure 1:
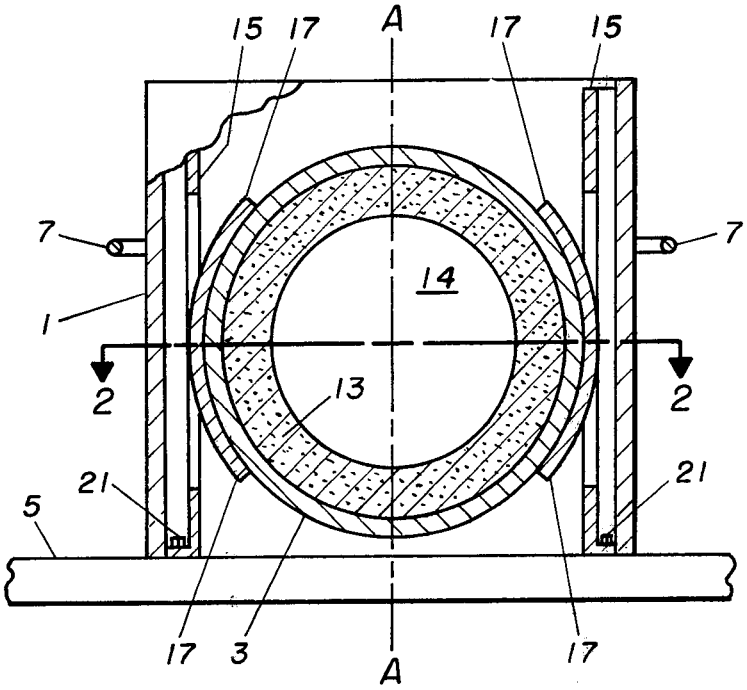
FIG. 1 is an axial section view of an assembled bomb container embodying the present invention mounted on a flat support, taken on line 1—1 of FIG. 2.
Figure 2:
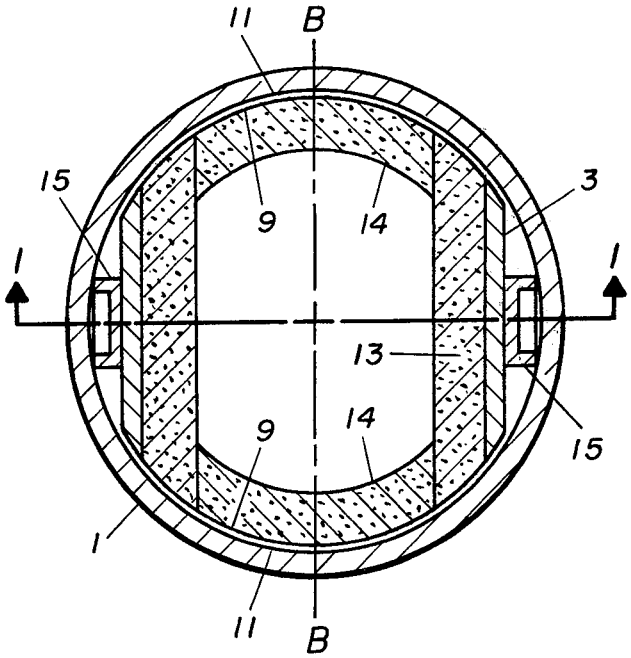
FIG. 2 is a transverse section view of the container, taken on line 2—2 of FIG. 1.

In the embodiment of the invention shown as an example in the drawing, the improved bomb container is made up of two open-ended thickwalled hollow steel cylinders 1 and 3, with cylinder 3 telescoped snugly within cylinder 1 as shown in FIGS. 1 and 2. Cylinder 1 is a right circular hollow cylindrical section having a length somewhat greater than its inner diameter, and it normally rests on a flat surface 5, such as the the bed of a truck or trailer (not shown). At least two ears 7, or other handling means are attached to the side of cylinder 1, to provide means for lifting it to expose the inner cylinder 3 and thus open the container, for inserting or removing a bomb (not shown).

The inner cylinder 3 is a circular hollow cylindrical section having an outer diameter somewhat less than the inner diameter of cylinder 1, with its longitudinal axis B—B oriented substantially perpendicular to the axis A—A of the outer cylinder 1, and with its open ends 9 cut to closely fit the contour of the inner surface 11 of the outer cylinder 1, as best shown in FIG. 2. The fit between the two cylinders at these contoured ends 9 is not intended to be a gastight seal, but is a close fit to cause the gas pressure within the cylinder 3 to gradually leak down to atmospheric in the event of an explosion of a bomb contained therein.

Preferably, the inner cylinder 3 contains a thick walled liner 13, e.g. of foam plastic, vermiculite or other suitable material for positioning the bomb near the center of the cylinder 3. This liner also helps to break up and reduce the initial shock pressure level of the explosion. The open ends of the liner 13 are also contoured to the shape of the inner surface 11. The open ends of the liner 13 may also be closed by shaped plugs 14 of a material similar to that of liner 13.

The inner cylinder 3 could rest on its side on the support surface 5. In the example shown, the inner cylinder 3 is supported or mounted, in spaced relation to the surface 5, by means of two elongated channel brackets 15 having struckout ears or straps 17 bent into arcuate shape and attached, as by welding, at locations 19 to opposite sides of the cylinder 3. The bottom ends of brackets 15 may be attached to the support 5, as by bolts 21.

Figure 3:
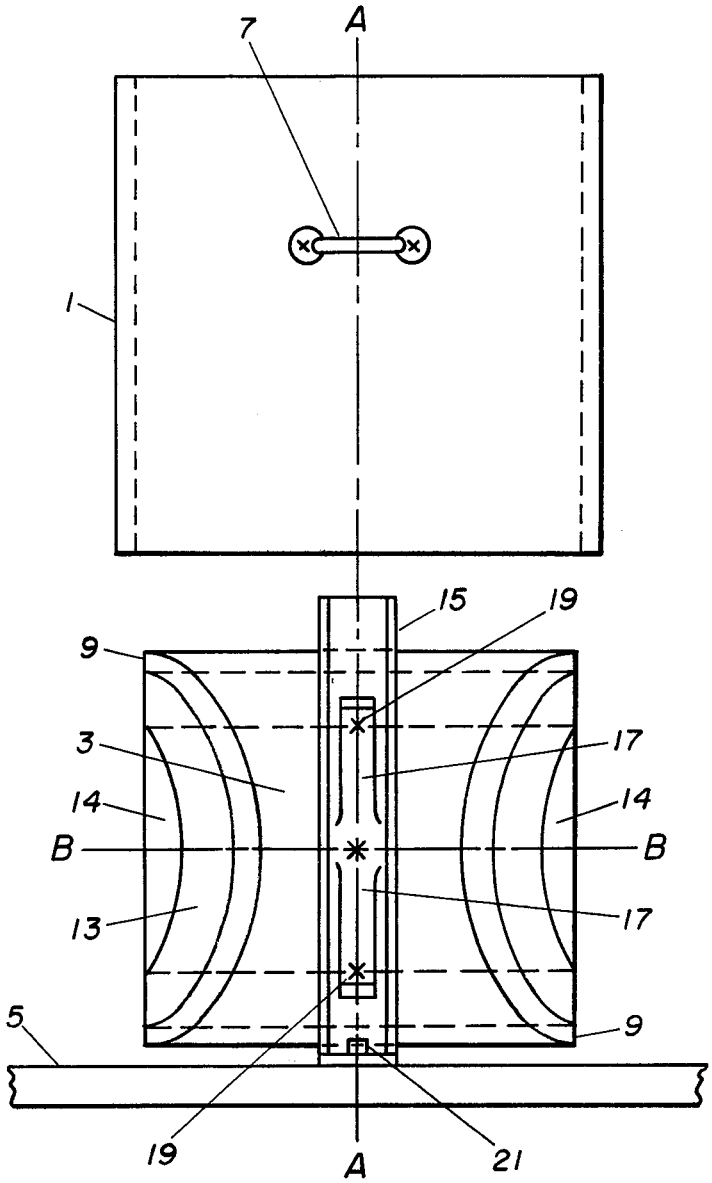
FIG. 3 is side view of the bomb container of FIGS. 1 and 2 in open or unassembled relations, that is, with the two cylindrical parts thereof axially separated.

When it is necessary to store or carry a bomb to a safe place, the container 1, 3 is opened, as by elevating the outer cylinder 1 to a position such as that shown in FIG. 3, to expose the open ends of the inner cylinder 3; the bomb is inserted, either manually or otherwise: and then the container is closed merely by lowering the outer cylinder 1 to the telescoped position shown in FIG. 1. A bomb can be placed in the container from a safe distance, by pulling a sled or car carrying the bomb up an incline and onto the surface 5, and then transferring the bomb from the carrier to the inner cylinder 3, by means of one or more long ropes or cables (not shown).

The invention provides a bomb container which affords substantially as much protection for bomb disposal personnel as a spherical container at much less expense. Cylinders are relatively cheap compared to spheres and their doors. The two cylinders may be relatively inexpensive sections of thick-walled steel pipe; and the expense of contouring the open ends of the inner cylinder is considerably less than that of providing a satisfactory door design for a spherical container. Another advantage of the improved container is easier and safer loading and unloading, because there is no separate door to be opened, and remote loading is possible. With a spherical container the door must usually be opened and closed by an attendant who is exposed to the danger of explosion at any time. Instead of lifting the outer cylinder, the two cylinders could be separately supported and the inner cylinder could be lowered, to open the container for loading or unloading.

What is claimed is:

1. A bomb container comprising:

a first open-ended hollow member of high-strength, tough material, adapted to rest either on one end or the side: and a second open-ended hollow member of similar material positioned completely within said first member with the longitudinal axes of the two members substantially perpendicular to each other, the ends of said second member being contoured to the inner wall of said first member with only a small clearance therebetween: whereby the fragments and blast pressure from the explosion of a bomb within said second member are safely contained.

2. A bomb container as in claim 1, wherein said first hollow member is a right cylinder resting at one open end on a flat support, and said second hollow member is a cylinder mounted on said support independently of said first cylinder: whereby said first cylinder can be removed from said second cylinder to open said container.

3. A bomb container as in claim 2, comprising a pair of elongated mounting brackets attached to opposite sides of said second cylinder and mounted on said support, and plurality of lifting ears attached to the outer surface of said first cylinder.

4. A bomb container as is claim 1, wherein said hollow members are sections of thick-walled steel pipe.

5. A bomb container as in claim 1, further comprising a thickwalled liner in said second member of a material capable of supporting a bomb near the middle of the member and of breaking up and reducing the initial shock pressure level of the explosion.

6. A bomb container as in claim 5, wherein said liner is made of foam plastic.

* * * * *